US006612912B2

(12) United States Patent
Yasui et al.

(10) Patent No.: US 6,612,912 B2
(45) **Date of Patent: *Sep. 2, 2003**

(54) METHOD FOR FABRICATING SEMICONDUCTOR DEVICE AND PROCESSING APPARATUS FOR PROCESSING SEMICONDUCTOR DEVICE

(75) Inventors: Kan Yasui, Kokubunji (JP); Souichi Katagiri, Kodaira (JP); Shigeo Moriyama, Tama (JP); Yoshio Kawamura, Kokubunji (JP); Ryousei Kawai, Kodaira (JP); Sadayuki Nishimura, Yokohama (JP); Masahiko Sato, Kokubunji (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/371,003

(22) Filed: Aug. 10, 1999

(65) Prior Publication Data

US 2002/0119733 A1 Aug. 29, 2002

(30) Foreign Application Priority Data

Aug. 11, 1998 (JP) ..... 10-226872
Apr. 8, 1999 (JP) ..... 11-101276

(51) Int. Cl.[7] ..... B24B 1/00; B24B 19/00

(52) U.S. Cl. ..... 451/56; 451/285; 451/287; 451/443; 451/444

(58) Field of Search ..... 451/56, 283, 285, 451/287, 443, 444

(56) References Cited

U.S. PATENT DOCUMENTS

| | | | | | |
|---|---|---|---|---|---|
| 4,947,598 | A | * | 8/1990 | Sekiya | 125/11.01 |
| 5,384,986 | A | * | 1/1995 | Hirose et al. | 451/444 |
| 5,624,303 | A | | 4/1997 | Robinson | |
| 5,643,067 | A | * | 7/1997 | Katsuoka et al. | 451/444 |
| 5,782,675 | A | | 7/1998 | Southwick | |
| 5,785,585 | A | * | 7/1998 | Manfredi et al. | 451/444 |
| 5,827,112 | A | * | 10/1998 | Ball | 125/11.22 |
| 5,902,173 | A | | 5/1999 | Tanaka | |
| 6,039,635 | A | | 3/2000 | Mitsubashi et al. | |
| 6,059,921 | A | | 5/2000 | Kato et al. | |
| 6,099,393 | A | * | 8/2000 | Katagiri et al. | 451/444 |
| 6,113,462 | A | * | 9/2000 | Yang | 451/6 |
| 6,130,139 | A | * | 10/2000 | Ukeda et al. | 438/424 |
| 6,312,324 | B1 | * | 11/2001 | Mitsui et al. | 125/39 |

FOREIGN PATENT DOCUMENTS

| | | | |
|---|---|---|---|
| EP | 803 326 | | 10/1997 |
| EP | 999 013 | | 4/1999 |
| JP | 7-249601 | | 9/1995 |
| JP | 9-29630 | * | 2/1997 |
| WO | WO97/10613 | | 3/1997 |

* cited by examiner

*Primary Examiner*—M. Rachuba
(74) *Attorney, Agent, or Firm*—Mattingly, Stanger & Malur, P.C.

(57) ABSTRACT

A method for fabricating a semiconductor device includes grindstone surface activation treatment by means of a brush or ultrasonic wave carried out when a concave/convex pattern of a semiconductor wafer is planarized by polishing a semiconductor wafer held by a wafer holder by using a grindstone constituted of abrasive grains and material for holding the abrasive grains onto which the semiconductor wafer is pressed with relative motion. The semiconductor wafer is processed with high removal rate and the polishing thickness is controlled accurately.

33 Claims, 16 Drawing Sheets

METHOD FOR FABRICATING SEMICONDUCTOR DEVICE AND PROCESSING APPARATUS FOR PROCESSING SEMICONDUCTOR DEVICE

BACKGROUND OF THE INVENTION

The present invention relates to a method for fabrication of a semiconductor device which comprise a polishing process for planarizing the surface pattern in fabrication of an integrated semiconductor circuit and an apparatus suitable for processing the semiconductor device.

A fabrication process for fabricating a semiconductor device comprises many processing steps. A metallization process is described with reference to FIG. 2(*a*) to FIG. 2(*f*) as an example of a process comprising a polishing step.

FIG. 2(*a*) shows a cross section of a wafer on which the first wiring layer has been formed. A dielectric film 2 is formed on the surface of a wafer substrate 1 having a transistor unit (not shown in the drawing), and a wiring layer 3 of aluminum is formed thereon. Because a hole is provided on the dielectric film 2 for serving to connect to the transistor, the surface of a portion 3' is somewhat concave above the hole. In the step for forming the second wiring layer shown in FIG. 2(*b*), a dielectric film 4 and aluminum layer 5 are formed on the first layer, and further a photo resist layer 6 is formed to pattern the aluminum layer 5 in the form of wiring. Next as shown in FIG. 2(*c*), the circuit pattern is transferred by exposing on the photo resist 6 by use of a stepper 7. At that time, the focus can not be adjusted both on the convex surface and the concave surface of the photo resist layer 6, and a serious defocus problem is caused.

To solve the problem, planarization processing of the substrate surface is carried as described herein under. Subsequently to the processing step shown in FIG. 2(*a*), a dielectric film is formed as shown in FIG. 2(*d*) and then the dielectric film is polished to the predetermined level 9 in the drawing to planarize the surface by a method described hereinafter, and the surface of the dielectric film 4 is planarized as shown in FIG. 2(*e*). Thereafter, an aluminum layer 5 and photo resist layer 6 are formed and exposed by use of a stepper 7 as shown in FIG. 2(*f*). In this case, the defocus problem is not caused because the surface of the photo resist layer 6 is planer.

CMP (Chemical Mechanical Polishing) process which has been used generally to planarize a dielectric pattern is shown in FIG. 3. A polishing pad 11 which is adhered on a platen 12 is being rotated. For example, a foamed polyurethane resin sheet which is formed by slicing a foamed polyurethane resin block is used as the polishing pad. However, generally the material of the polishing pad is selected in view of property and surface structure of materials depending on type of the object to be processed and desired surface finish roughness. On the other hand, a wafer substrate 1 to be processed is fixed on a wafer holder 14 with interposition of an elastic backing pad 13. A wafer substrate 1 is pressed on the surface of the polishing pad 11 while the wafer holder 14 is being rotated, polishing slurry 15 is supplied on the polishing pad 11 to remove and planarize the convex portion of the dielectric film 4 on the wafer surface.

For polishing a dielectric film of such as silicon dioxide, generally fumed silica is used as the polishing slurry. The fumed silica is a suspension formed by suspending fine silica particulate having a diameter of about 30 nm in an alkaline solution containing alkali such as ammonia or potassium hydroxide. A plane surface is obtained without damage by use of fumed silica.

In CMP processing using abrasive grain suspension, an object is polished while polishing slurry is fed between a polishing pad and the object, the following problem arises due to use of the polishing pad and polishing slurry.

First, the capability of planarization is not sufficient because the Young's modulus of the polishing pad is not high. Because the polishing pad is in contact not only with convex portion but also with concave portion of the wafer surface because of the pressure during polishing. That is particularly true for larger pattern. The planarizable maximum pattern size is several mm width for a method in which the polishing pad is used, and it is difficult to sufficiently planarize a pattern having a size as large as several cm which is required for, for example, DRAM. Next, the special caution is needed when dealing with the polishing slurry, the special caution results in high cost. Dried polishing slurry can not be removed easily, and residual polishing slurry is the source of dust which adversely affects the cleanliness in a clean room. Abrasive grains in the polishing slurry aggregate each other with time to form aggregated particles. The aggregated particles cause damage such as scratch. The polishing slurry generally contains alkali, and the apparatus should be adapted to alkali. As the result, a polishing slurry supplying equipment to be used exclusively is required and the polishing slurry is expensive itself. Therefore, the processing cost for a CMP processing method in which abrasive grain suspension is used is high. Further, there arises a problem that the shape of the surface of a polishing pad is deformed with using and the removal rate (efficiency of polishing) decreases. To resume the removal rate, a polishing pad is reclaimed every time when one wafer substrate is processed or when processing simultaneously, which reclamation is generally called as dressing. A file referred to as dresser which is formed by electrically depositing diamond abrasive grains is used to roughen the surface of the polishing pad, and the removal rate is resumed.

As the wafer substrate planarization processing technique for solving the problem associated with CMP processing by use of abrasive grain suspension, a part of the inventors of the present invention proposed the planarization technique with grindstone in which fixed abrasive was used (International application open laid; WO 97/10613).

FIG. 4 is a schematic diagram for describing the planarization processing using grindstone. The basic structure of the apparatus is the same as that used in CMP polishing technique in which a polishing pad and abrasive grain suspension are used, but this apparatus is different from the conventional CMP polishing technique in that a grindstone 16 containing abrasive grains of cerium oxide instead of a polishing pad. It is possible to polish by merely supplying deionized water which contains no abrasive grain instead of fumed silica slurry as a polishing supply. This method in which a grindstone is used as polishing tool is excellent in capability of planarizing pattern topography, and it is possible to sufficiently planarize a pattern having several mm width, which is difficult to be planarized by the conventional method. The process cost is reduced by employing this method because a grindstone which is excellent in utilization of abrasive grain, is used instead of polishing slurry which is inferior in utilization.

Japanese Unexamined Patent Publication No. Hei 7-249601 discloses a polishing technique in which a grindstone for polishing bare wafers is cleaned by jetting high pressure fluid or by use of a brush, however this conventional technique addresses neither on the method for polishing a wafer on which a device is formed nor the method for planarization of a wafer on which a device is formed.

On the other hand, U.S. Pat. No. 5,624,303 discloses a method in which a polishing pad containing abrasive grains to which treatment for preventing breaking down of abrasive grain is applied, and U.S. Pat. No. 5,782,675 discloses a method for conditioning to prevent breaking down of abrasive grains of a polishing pad containing abrasive grains.

The techniques in which a grindstone is used for polishing is excellent in low cost and planarization capability, however involved in the problem as described herein under.

First, the removal rate of the method in which only deionized water is used as the process fluid is as low as about ⅓ of the removal rate of a method in which abrasive grain suspension is used. In the polishing in which a grindstone is used, the removal rate falls down with time of polishing similarly to the polishing method in which a polishing pad and polishing slurry are used. It is difficult to adjust the polishing thickness to a desired value unless the removal rate is maintained at a constant value.

The mechanism of deterioration of removal rate using a grindstone is not necessarily the same as that of removal rate using a polishing pad and polishing slurry. In the case of combination of a polishing pad and polishing slurry, abrasive grains are not fixed on a polishing pad, which is a polishing process tool, and free from the polishing pad during polishing, on the other hand in the case of a grindstone, abrasive grains are fixed on a polishing process tool itself and the fixed abrasive grains are involved in polishing, there is big difference in mechanism between the former and the latter. The removal rate deterioration in polishing using a polishing pad and a liquid (slurry) containing abrasive grains is attributed to the decrement in abrasive grain retainability due to deformation of the polishing pad surface and to the increment in effective contact surface. On the other hand, the removal rate deterioration in polishing using a grindstone is attributed to the decrement in the number of abrasive grains exposed on the grindstone surface and the deterioration of chemical activity of the abrasive grain surface. To activate the surface of a grindstone so that the removal rate does not fall down, a method based on a principle which is different from a principle for the other polishing method is required.

SUMMARY OF THE INVENTION

It is an object of the present invention to provide a method for fabricating a semiconductor device including a polishing step for polishing at high removal rate so as to control the polishing thickness desiredly.

It is another object of the present invention to provide a processing apparatus for polishing at high removal rate so as to control the polishing thickness.

To achieve this and another objects, a method for fabricating a semiconductor device of the present invention includes grindstone surface activation treatment carried out when a concave/convex pattern is planarized by polishing a semiconductor wafer having concave/convex pattern thereon by use of a grindstone comprising abrasive grains and material for holding the abrasive grains onto which the semiconductor wafer is pressed with relative motion.

The grindstone surface activation treatment maybe carried out by use of a brush pressed onto the grindstone or by transmitting ultrasonic wave or acoustic wave having a frequency of 10 kHz or higher. The surface activation treatment is by no means limited to the methods, otherwise the surface activation treatment may be carried out by pressing a diamond dresser onto the grindstone.

A single substance or mixture containing two or more substance of silicon dioxide, cerium oxide, aluminum oxide, silicon carbide, manganese oxide, and zirconia is preferably used as the abrasive grain, and an organic resin is preferably used as the material for holding the abrasive grain. A grindstone disclosed in the PCT application, PCT/JP 95/01814 (International Laid Open No. WO 97/10613), may be used as the grindstone to be used in this invention. It is preferable that a grindstone contains micro-pores and the micro-pores having a diameter of 1 $\mu$m or smaller occupy at least 95% ($2\sigma$) of the total pore volume. A liquid which is deionized water or deionized water containing additives is supplied onto the surface of a grindstone as a processing liquid.

To achieve this and another objects, a processing apparatus for processing a semiconductor device is provided with the first means for holding a semiconductor wafer having the concave/convex pattern formed on the surface, a grindstone comprising abrasive grains and material for holding these abrasive grains, the second means for pressing the semiconductor wafer surface onto the grindstone and for moving the semiconductor wafer surface relatively to the grindstone, and the third means served for surface activation treatment.

A brush, or a means for generating ultrasonic wave or acoustic wave having a frequency of 10 kHz or higher and means for transmitting the ultrasonic wave or acoustic wave to the grindstone may be used as the third means. The grindstone is used as the grindstone.

In the grindstone surface activation treatment, a processing liquid which is deionized water or deionized water containing additives is supplied to the surface of a grindstone. A dispersant or pH buffer is used as the additives. It is preferable that the supply flow rate of processing liquid is 0.14 ml/cm$^2$ or less per minute per unit area of a grindstone. Abrasive grains and resin bonded weakly are liberated in a large amount from the surface of a grindstone by surface activation treatment. The increment of liberated abrasive grain concentration contributes to the increment of removal rate. It is preferable that the supply flow rate of processing liquid onto the surface of a grindstone is not excessive to maintain the liberated abrasive grain concentration high. FIG. 21 shows the relation between the amount of processing liquid and removal rate. The amount of processing liquid must be controlled at the optimal point to obtain high removal rate, the removal rate decreases if the amount of processing liquid is excessive.

In the case in which a brush is used as the surface activation treatment means, it is preferable that a brush is pressed further a certain distance toward the grindstone side from the position where the end of bristles of the brush just touches on the surface of a grindstone, and the pressing distance is preferably in a range from 0.1 to 5 mm. The contact of a brush is unstable and the removal rate is low if the pressing distance is shorter than 0.1 mm and on the other hand a grindstone can be damaged if the pressing distance is longer than 5 mm.

The role of a brush used in the present invention is to brush out process dust and broken down abrasive grains and to expose fresh abrasive grain surface. In the method for conditioning a polishing pad having fixed abrasive grains with a brush disclosed in the U.S. Pat. No. 5,782,675, the brush is used for soft conditioning in which fixed abrasive grains are not broken down, therefore the U.S. Pat. No. 5,782,675 is different from the present invention in principle.

Treatment which is so-called truing is applied periodically to correct the surface configuration of a grindstone and to maintain the surface planar. It is preferable that the planarity of the grindstone surface is 10 μm or lower. For truing, controlled depth machining may be applied. In this method for controlled depth machining, a ring or disk having a diameter of 30 to 70 mm on which abrasive grains of hard material such as diamond is embedded is rotated at a rotation speed of 3000 to 10000 rpm and the tool is moved relatively in the grindstone surface with maintaining the distance between the tool and grindstone in a constant value, thus the grindstone surface is trued at a high precision. In such controlled depth processing, the high positioning accuracy of the height of a tool results in the high planarity in principle. It is preferable in the present invention that the positioning accuracy of the height of a tool is 1 μm or lower. A correction ring or dresser which has been used heretofore to correct the tool plane in polishing processing such as lapping or CMP can not result high planarity because a correction ring or dresser cuts the tool surface with a constant pressure (constant pressure processing). Because a method in which a fixed abrasive grain polishing pad and a brush are used disclosed in the U.S. Pat. No. 5,782,675 is classified to the constant pressure processing in which the pressure of a brush is set, therefore the method can not likely result in high planarity.

By applying the controlled depth truing processing, the processing defect of wafer such as scratch is decreased and the uniformity within wafer of amount of removal is increased. Because the removal thickness of a grindstone by the truing processing is as small as several μm from the surface of the grindstone, the service life of a grindstone is very long.

The grindstone surface activation treatment using an abrasive grain supply source other than liquid may be applied as the grindstone surface treatment. A grindstone formed by bonding abrasive grains with resin, iced material formed by icing a liquid containing abrasive grains, or gel or aerosol of a liquid containing abrasive grains may be used as the abrasive grain supply source.

The first and second objects are achieved by applying surface treatment using a polishing pad and an abrasive grain supply source other than liquid instead of the grindstone for polishing a semiconductor wafer. At that time, a grindstone formed by bonding abrasive grains with resin, iced material formed by icing a liquid containing abrasive grains, or gel or aerosol of a liquid containing abrasive grains may be used as the abrasive grain supply source.

DETAILED DESCRIPTION OF THE PREFERRED EMBODIMENTS

EXAMPLE 1

Figure 1:
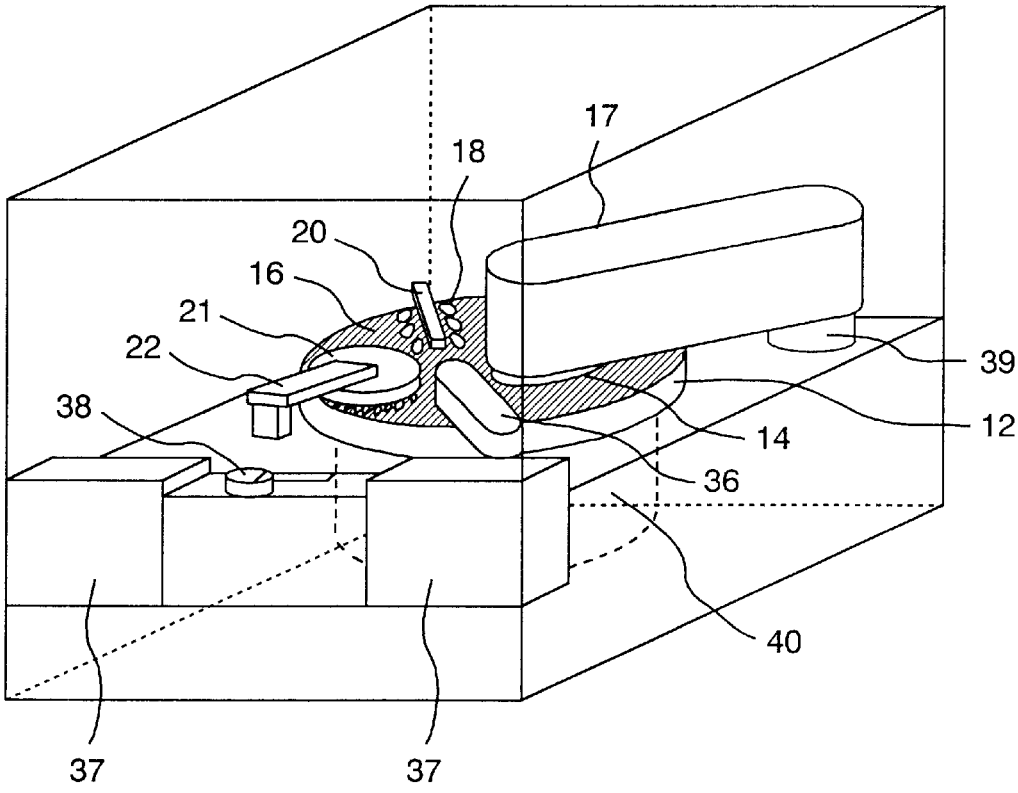
FIG. 1 is a schematic diagram for illustrating the structure of a processing apparatus in accordance with one example of the present invention.
Figure 2A:
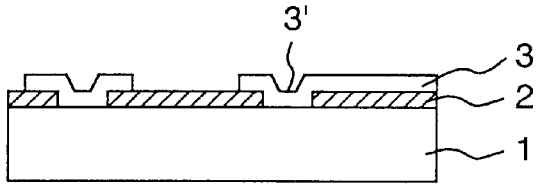
FIG. 2(*a*) to FIG. 2(*f*) are planarization process diagrams for planarizing the wafer surface.
Figure 2B:
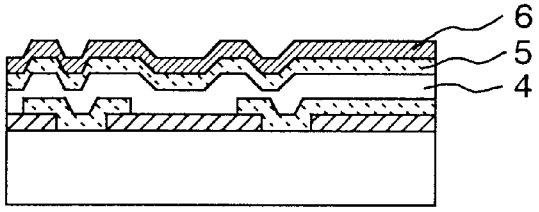
Figure 2C:
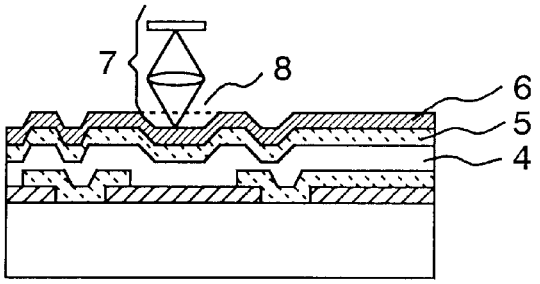
Figure 2D:
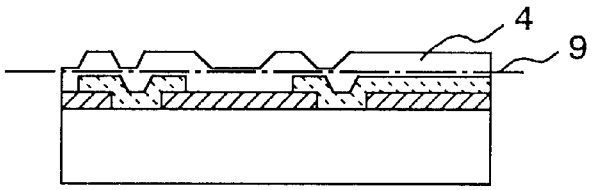
Figure 2E:
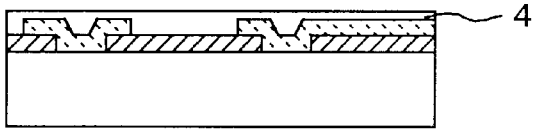
Figure 2F:
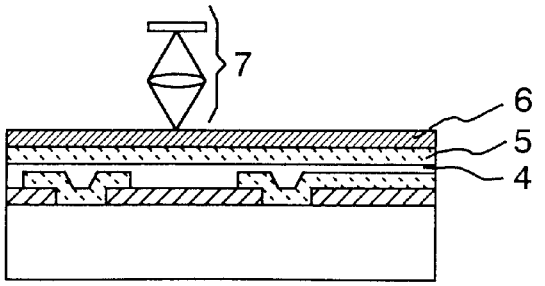
Figure 3:
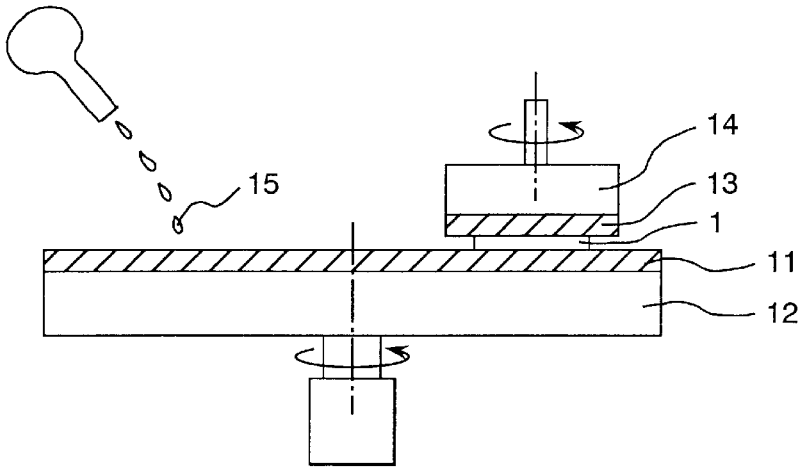
FIG. 3 is a diagram for describing a conventional chemical mechanical polishing process.
Figure 4:
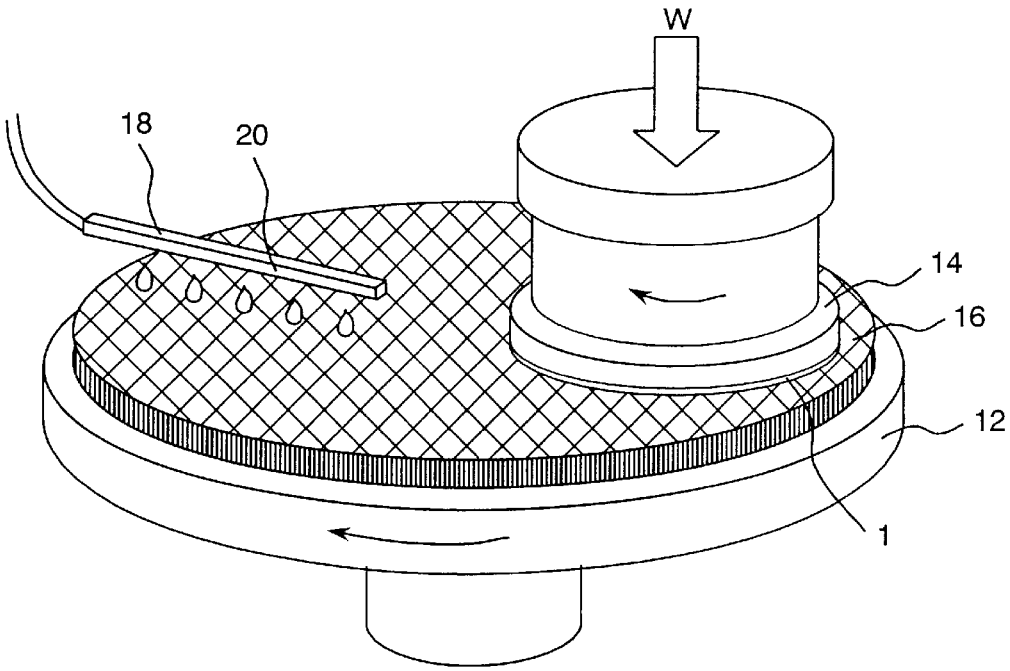
FIG. 4 is a diagram for describing a conventional planarization processing using a grindstone.

Examples of the present invention will be described hereinafter in detail with reference to the drawings. FIG. 1 is a schematic diagram for illustrating the basic structure of a processing apparatus in accordance with an example of the present invention. The processing apparatus comprising a grindstone 16, a platen 12 on which the grindstone 16 is adhered for rotation, a wafer holder 14, an arm 17 for driving, rotating, and sweeping the wafer holder 14, a brush 21 for acting on the surface of the grindstone 16, a brush arm 22 on which the brush is attached, and a truing unit 36. The grindstone 16 and the platen 12 are rotated by a driving motor 40, the brush 21 is rotated by a motor not shown in the drawing, and the wafer holder 14 is rotated together with the wafer by a motor not shown in the drawing. The arm 17 is driven by an arm driving motor 39. A wafer transfer robot 38 of a wafer load/unload unit 37 loads/unloads wafers on/from the wafer holder 14. The loading/unloading is performed in the same manner as used in the conventional apparatus, the description of the apparatus is omitted. Deionized water is supplied through a processing liquid supplying unit 20 during processing.

The wafer is held by the wafer holder 14 so that the face of the wafer faces on the grindstone 16. The wafer is pressed uniformly from the back side so as to be pressed onto the grindstone 16 during processing. The grindstone 16 and wafer holder 14 are rotated during processing, the rotation speed of both components are designed to be equal each other, the relative speed of the wafer held by the wafer holder 14 is equal each other with respect to the grindstone 16 at every point, and the wafer is polished evenly on the entire surface.

The brush 21 is maintained pressed and rotated continuously on the working surface of the grindstone 16 during processing, and the rotation center of the brush 21 is swept by the brush arm 22 to brush the entire service area of the grindstone 16.

The grindstone 16 comprises abrasive grains and material for holding these abrasive grains. A single substance or mixture containing two or more substance of silicon dioxide, cerium oxide, aluminum oxide, silicon carbide, manganese oxide, and zirconium oxide is preferably used as the abrasive grain, and an organic resin is preferably used as the material for holding the abrasive grain. A grindstone disclosed in the PCT application, PCT/JP 95/01814 (International Laid Open No. WO 97/10613), may be used as the grindstone.

Figure 5A:
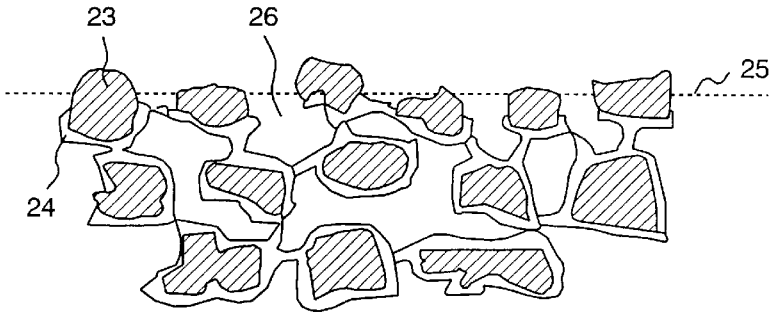
FIG. 5(*a*) to FIG. 5(*c*) are schematic diagrams for describing activation treatment of the grindstone surface.
Figure 5B:
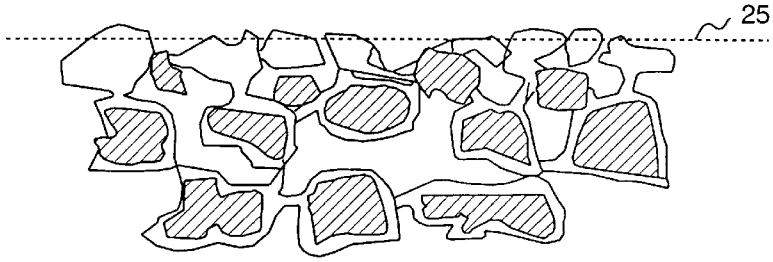
Figure 5C:
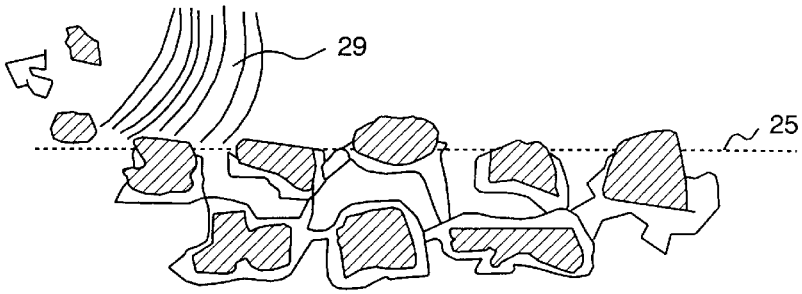

Referring to FIG. 5(*a*) to FIG. 5(*c*) the role of the brush is described. FIG. 5(*a*) to FIG. 5(*c*) are enlarged cross sectional conceptual diagram of the grindstone surface. The abrasive grains 23 which are components of the grindstone and the resin 24 for holding the abrasive grains are mixed homogeneously, and a number of fine pores are formed in the grindstone. FIG. 5(*a*) shows the surface of the grindstone before processing when the removal rate is high, a number of abrasive grains 23 are exposed on the surface 25 of the grindstone, and the pockets 26 is empty and not occupied by process dust. FIG. 5(*b*) shows the surface of the grindstone after use for processing, the abrasive grains are not found on the processing surface of the grindstone, and pockets where process dust is to be discharged is occupied already by process dust, such condition is so-called as loading. The removal rate is significantly low and not suitable for practical use under such condition, some surface activation treatment is required. In this example, so-called brush dressing in which a brush is used is applied as the surface activation treatment of the grindstone surface. FIG. 5(*c*) shows the grindstone surface which is now being activated by brush dressing, which grindstone has few exposed abrasive grains on the surface and has pockets filled with process dust where new process dust is to be discharged as shown in FIG. 5(*b*). Process dust and broken down abrasive grains filled in pockets are brushed out from the pockets, and the surface of resin layer only where abrasive grains are not held is removed with aid of proper pressure of the brush, thus fresh abrasive grains appear rapidly on the surface. The removal rate of the grindstone is restored by brushing the surface with bristle 29 of the brush, it is possible to suppress the time variation of the removal rate. The position of the grindstone surface 25 is lowered in FIG. 5(*b*) and FIG. 5(*c*).

Figure 6:
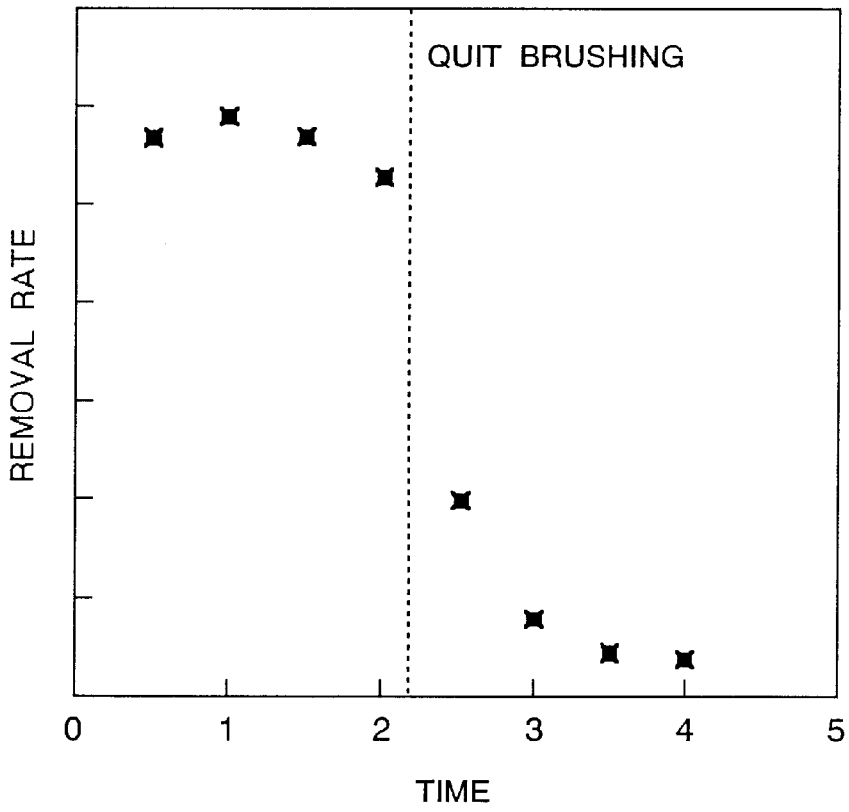
FIG. 6 is a diagram for describing the effect of activation treatment using a brush.

FIG. 6 is a diagram for describing the variation in removal rate with time in comparison between with brushing and without brushing. The abscissa represents the time, and the ordinate represents the removal rate. The brush processing continues from the beginning of the experiment, and only the brushing is quitted at the time point of a broken line. The removal rate stably shows high level during brush processing, but falls down sharply from the moment when brushing is quitted. The removal rate with brushing is 5 times or more larger than that without brushing, and the removal rate decreases with processing time in the case of without brushing.

Figure 7:
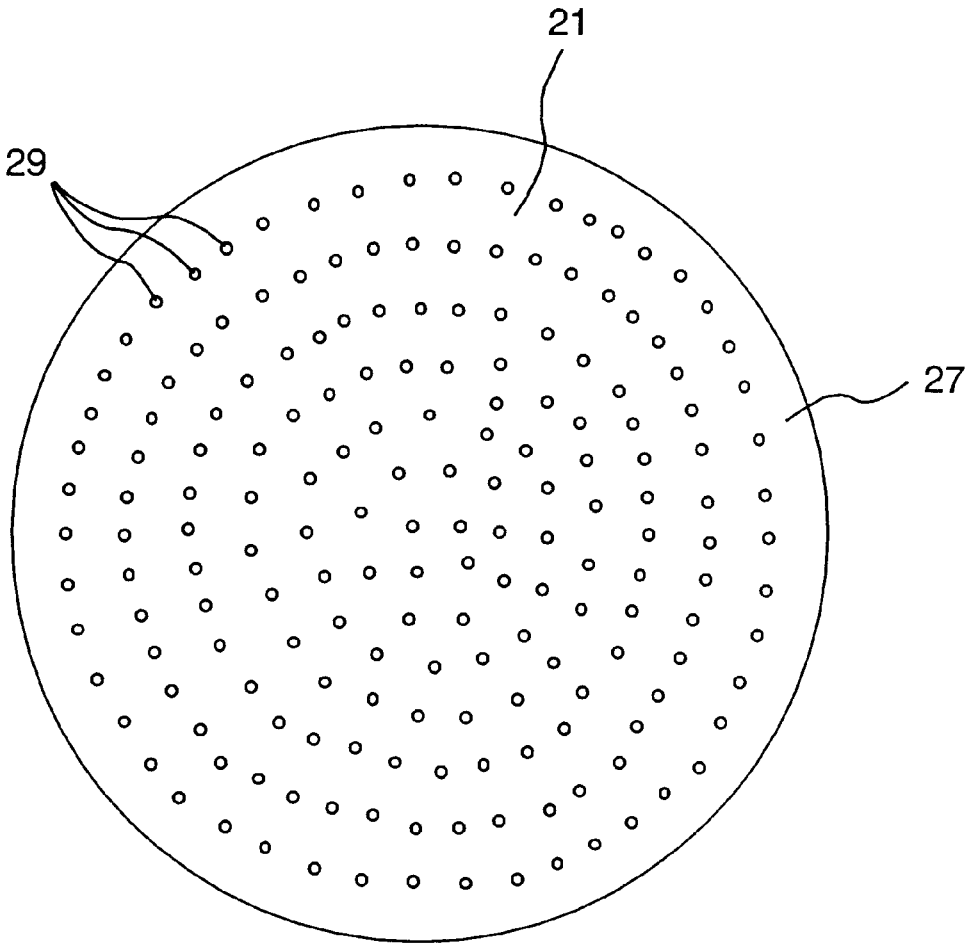
FIG. 7 is a diagram for describing a circular brush used for activation treatment of the grindstone surface.
Figure 8:
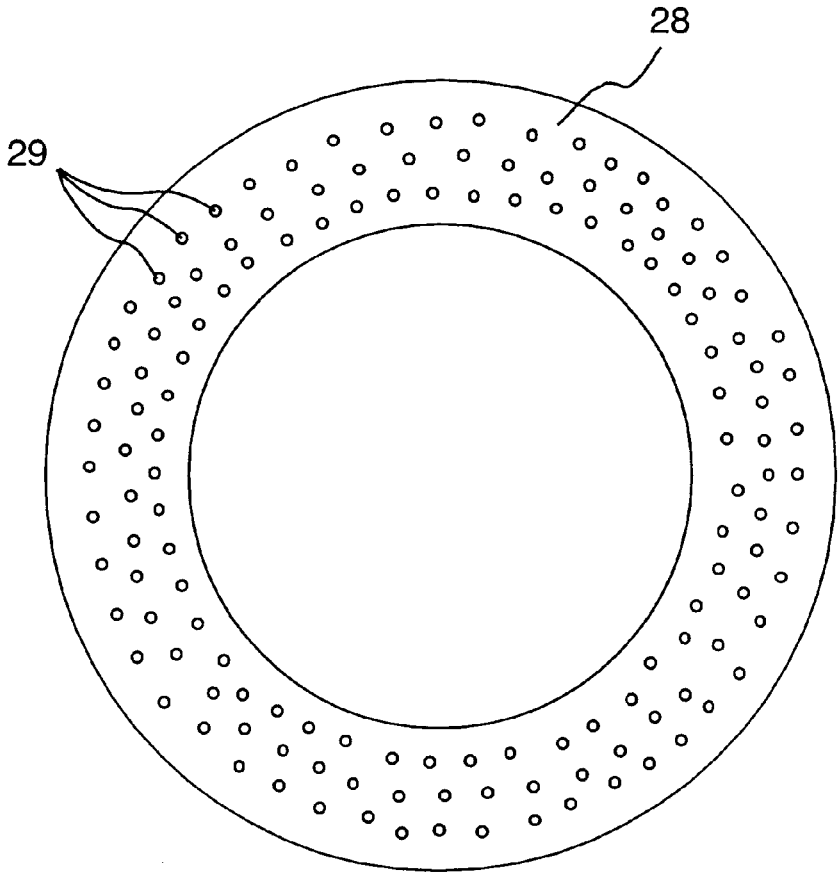
FIG. 8 is a diagram for describing a ring brush used for activation treatment of the grindstone surface.

A brush 21 having a disk-like base plate 27 to which bristle 29 is filled on the entire surface as shown in FIG. 7 is used, and the brush 21 is swept by the brush arm 22 shown in FIG. 1 during processing to activate uniformly on the wide area of the grindstone. A ring-shaped brush 28 shown in FIG. 8 may be used as the brush. In the case of ring-shaped brush, though the total contact area between the grindstone and the brush is smaller, the distribution of residence time of the brush is uniform in the radial direction of the grindstone, and the uniformity of the surface activation treatment is more uniform on the grindstone.

A brush having a large diameter equivalent to the radius of the grindstone is advantageous in that the entire surface of the grindstone is activated rather uniformly without sweeping of the brush itself on the grindstone. On the other hand, a brush having a small diameter of, for example, 5 cm is advantageous in that the size of the whole processing apparatus is made small, though sweeping by use of the mechanical means such as the arm 22 shown in FIG. 1 is necessary. The rotation speed of the brush is preferably in a range from 20 to 100 rpm. The removal rate decreases if the rotation speed is out of the range.

EXAMPLE 2

Figure 9:
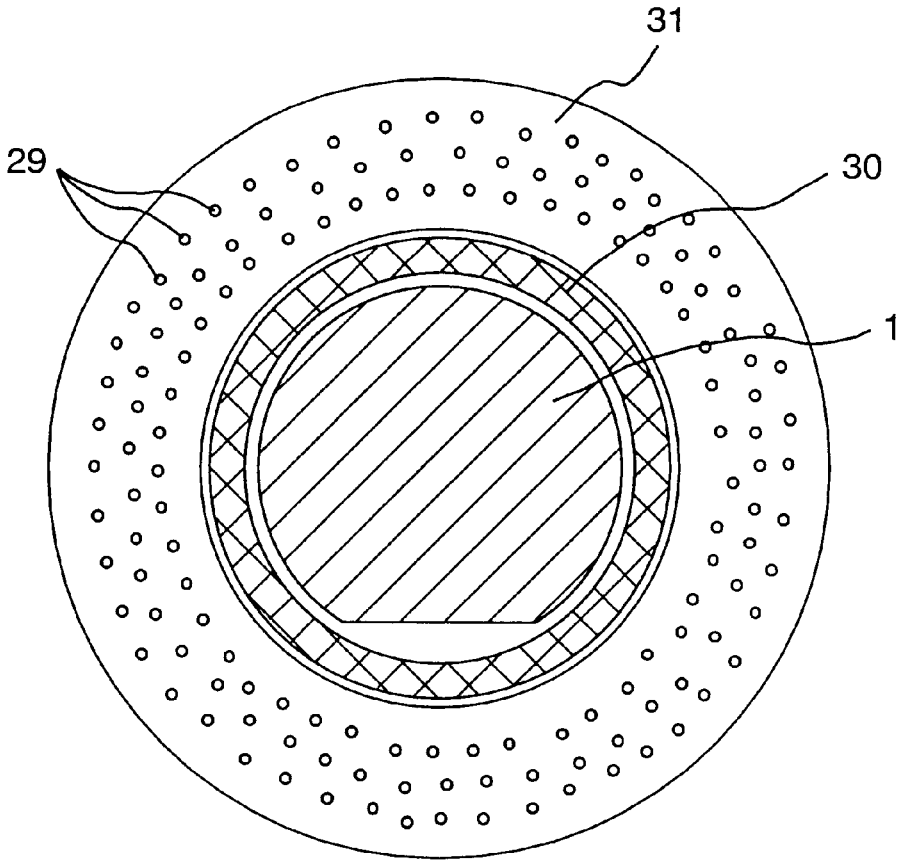
FIG. 9 is a diagram for describing a wafer built-in brush used for activation treatment of the grindstone surface.

As the second example of surface activation treatment by use of a brush, an example in which a brush is located around the wafer holder is shown. FIG. 9 is a bottom view of a wafer holder 14, on which bottom a wafer is held. A retainer ring 30 is provided to prevent the wafer from falling down during processing on the periphery of the wafer holder 14, and a brush 31 is provided outside the retainer ring 30 for activation treatment on the grindstone surface. In this case, the wafer holder for wafer processing is combined with the brush for grindstone surface activation treatment, and it is not necessary to provide a brush sweeping means separately.

EXAMPLE 3

Figure 10:
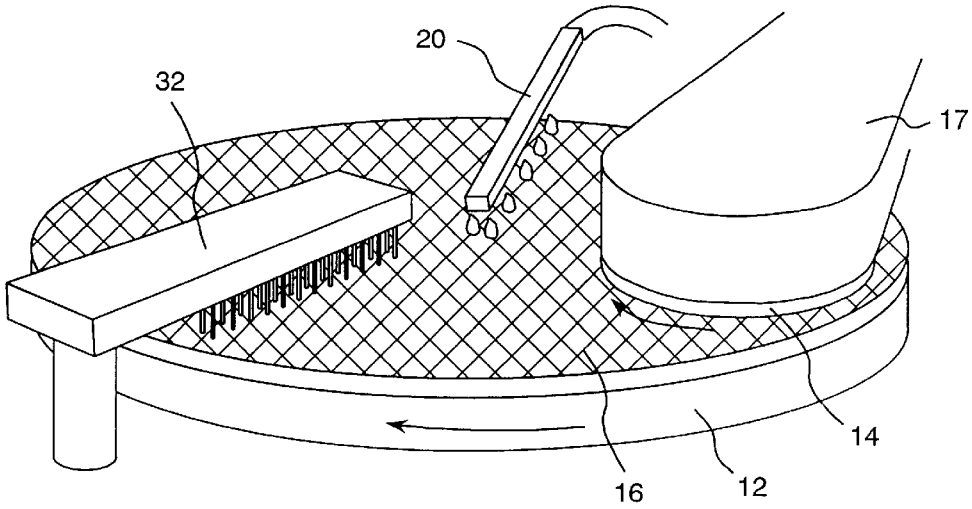
FIG. 10 is a diagram for describing a linear brush used for activation treatment of the grindstone surface.

As the third example of surface activation treatment by use of a brush, a method in which a linear brush 32 is provided is shown in FIG. 10. The linear brush 32 is located on a grindstone instead of circular or ring-shaped brush shown in the examples. It is not necessary to rotate the brush itself differently from the circular brush, and the same effect is obtained. Further, it is not necessary to sweep the brush if the length of the linear brush is equal to the radius of the grindstone. A brush having a smaller diameter may be used with sweeping in the radial direction.

Organic resin is suitably used as the material of bristles 29 of a brush used in the first to third examples. A brush of nylon is used in the examples because nylon has suitable hardness and stability which are required for the material of bristle of the brush and contains very small amount of impurity as little as applicable to semiconductor use. The diameter of a bristle of the brush is preferably in a range from 0.05 to 2 mm.

Figure 11:
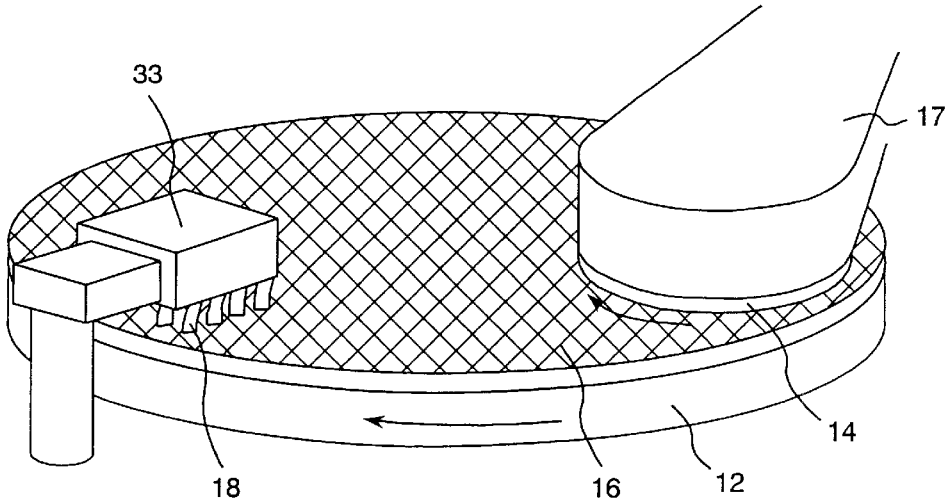
FIG. 11 is a diagram for describing activation treatment of a grindstone surface using an ultrasonic vibrator.

As the fourth example, a method in which an ultrasonic vibrator is used as the surface activation treatment means is described. As shown in FIG. 11, an ultrasonic vibrator 33 is provided above the grindstone, and processing liquid such as deionized water is supplied from the ultrasonic vibrator 33. The ultrasonic wave is transmitted to the surface of the grindstone 16 through processing liquid 18. Abrasive grains and resin for bonding abrasive grains are vibrated strongly and liberated from the grindstone to become free abrasive grains, and the fresh grindstone surface from which process dust in pockets is discharged is exposed to resume the removal rate. The ultrasonic vibrator is advantageous in that deterioration with time due to brush wear is prevented based on the principle, and the surface activation treatment continues stably for long time. Therefore, the ultrasonic vibrator is additionally advantageous in that failure due to adhered dust or coagulated adhered abrasive grains when dried is prevented.

In this example, an example in which ultrasonic wave is used is shown, however sound wave having a frequency of 10 kHz or higher is also effective. Ultrasonic wave having a frequency of 100 kHz or lower is preferably used. Acoustic wave having such frequency causes cavitation in deionized water to cause liberation of abrasive grains, and the discharging efficiency of process dust is improved. A frequency range from 20 to 50 kHz is more preferably used. This range is true for the following description.

Figure 12:
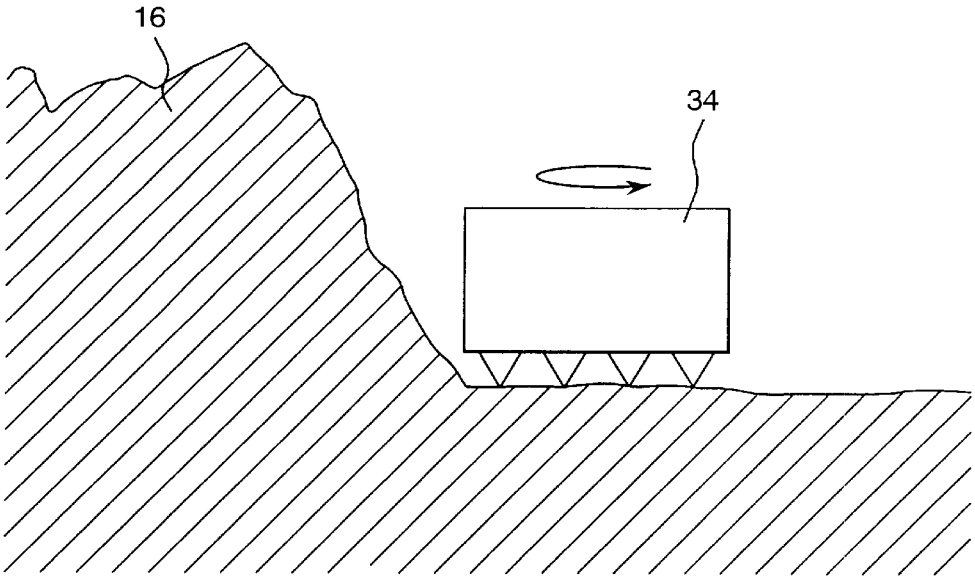
FIG. 12 is a diagram for describing truing treatment of a grindstone surface.
Figure 13:
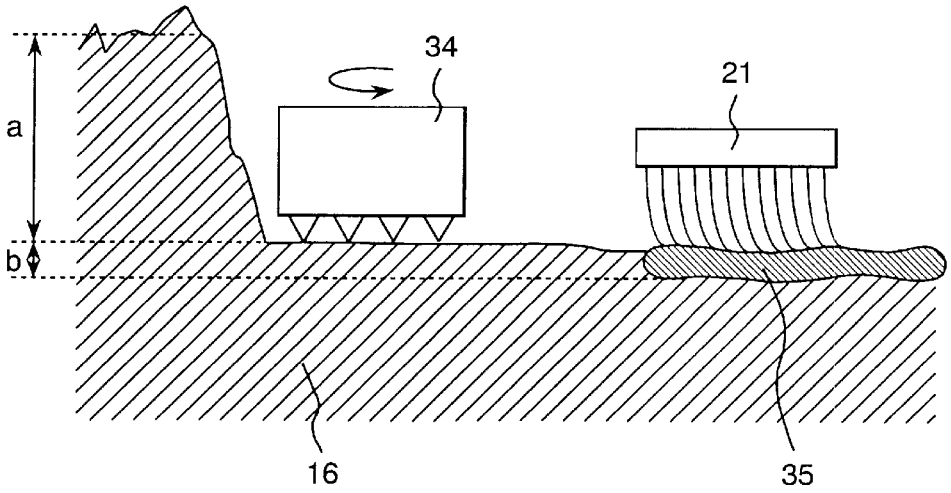
FIG. 13 is a diagram for describing the depth of surface activation treatment of a grindstone.

The intensity of the grindstone surface activation by use of the surface activation treatment means is determined in view of the following points. In polishing processing in which a grindstone is used, processing so-called truing is carried out to modify the grindstone surface configuration every time when one wafer is processed or simultaneously with processing as shown in FIG. 12. To modify the grindstone surface, the grindstone surface is subjected to controlled depth machining by use of a grinding tool 34 on which abrasive grains of diamond is bonded to planarize the grindstone surface configuration. The grindstone surface configuration is planarized with the accuracy of several $\mu$m or less in the depth direction by this operation to secure the uniformly processed entire surface of a wafer. The wear of a grindstone by truing is usually 10 $\mu$m or less. In the surface activation treatment by means of ultrasonic wave, it is required that the surface is activated in the range so that the planarity of a grindstone is not decreased. Therefore, the affected thickness range of the surface activation treatment in the depth direction is controlled so as to be equal to or less than the amount of wear of a grindstone by means of truing as shown in FIG. 13. In detail, by controlling pressing force of a brush, rotation speed of the brush, the hardness of the brush, or the frequency or power of ultrasonic wave, the affected depth 35(*b*) of surface activation by means of the surface activation treatment means is controlled to be equal to or less than the amount of wear (a) of a grindstone by means of truing, namely a>b. The truing unit 36 shown in FIG. 1 is a means for truing.

A grindstone to which the surface activation treatment means is particularly effective is a ultra micro-porous grindstone containing micro-pores having a diameter of 1 $\mu$m or smaller which occupy at least 95% ($\pm 2\sigma$) of the total pore volume. It is possible to limit the affected range in the depth direction affected by means of a surface treatment means such as a brush within only the surface layer having a depth of several $\mu$m from a grindstone surface, if the pore diameter is very small and equal to or less than 0.1 to 2 $\mu$m, which is equivalent to the average size of abrasive grains. In such case, the change of the grindstone surface configuration due to the surface treatment is not significant, the removal rate improvement effect is spatially uniform and continues for long time. The pore diameter is measured by means of the method of mercury penetration (porosimeter).

Figure 14:
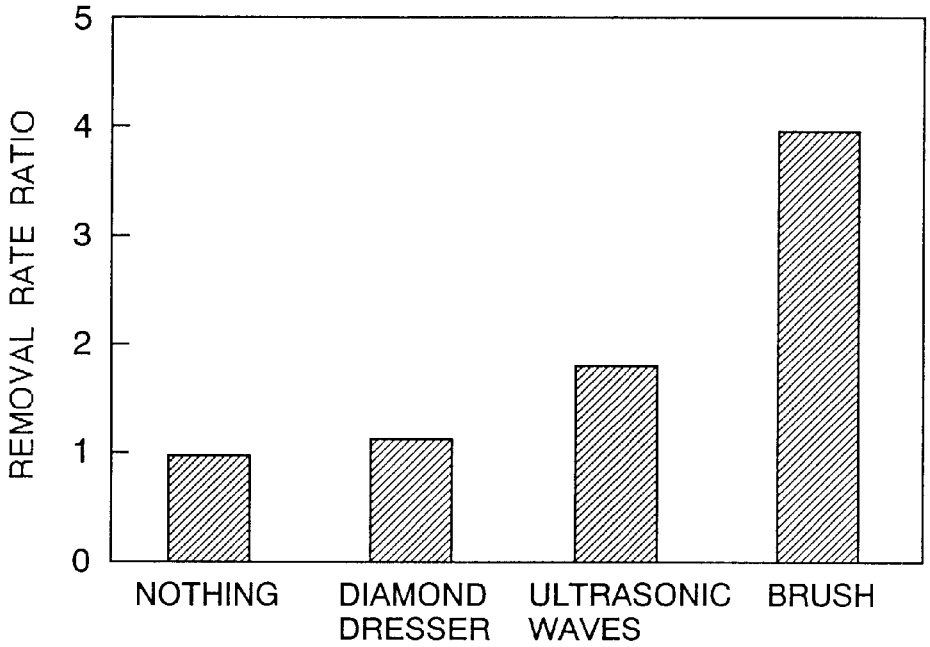
FIG. 14 is a diagram for comparing the effect of methods for surface activation treatment.

In the example, a brush or ultrasonic wave is used as the activation treatment method for activating a grindstone, however, in the meaning that fresh abrasive grains and openings of micro-pores are exposed on the surface of a grindstone to maintain the polishing efficiency high, grindstone such as diamond grindstone or grindstones containing other abrasive grains, PVA brush, sponge brush, and water jet in addition to nylon brush may be used as the activation treatment means. However, the surface activation treatment using a brush or ultrasonic wave is suitable in that the grindstone surface is sufficiently activated while the affected range in the depth direction due to the surface activation treatment is limited to the amount of truing of the grindstone namely 10 $\mu$m or less as described herein above. In FIG. 14, comparative result of the removal rate ratio (improvement) between typical surface activation means is shown. In comparison with nothing, the removal rate is improved in the order from the best of brush, to ultrasonic wave, and diamond dresser. The timing when the activation treatment is carried out is described. The activation treatment may be continued during entire polishing processing simultaneously as in the cases of the examples described herein above, however otherwise, the activation treatment may be carried out between this processing and the next processing, or the activation treatment may be carried out partially simultaneously during polishing processing.

EXAMPLE 5

Figure 15:
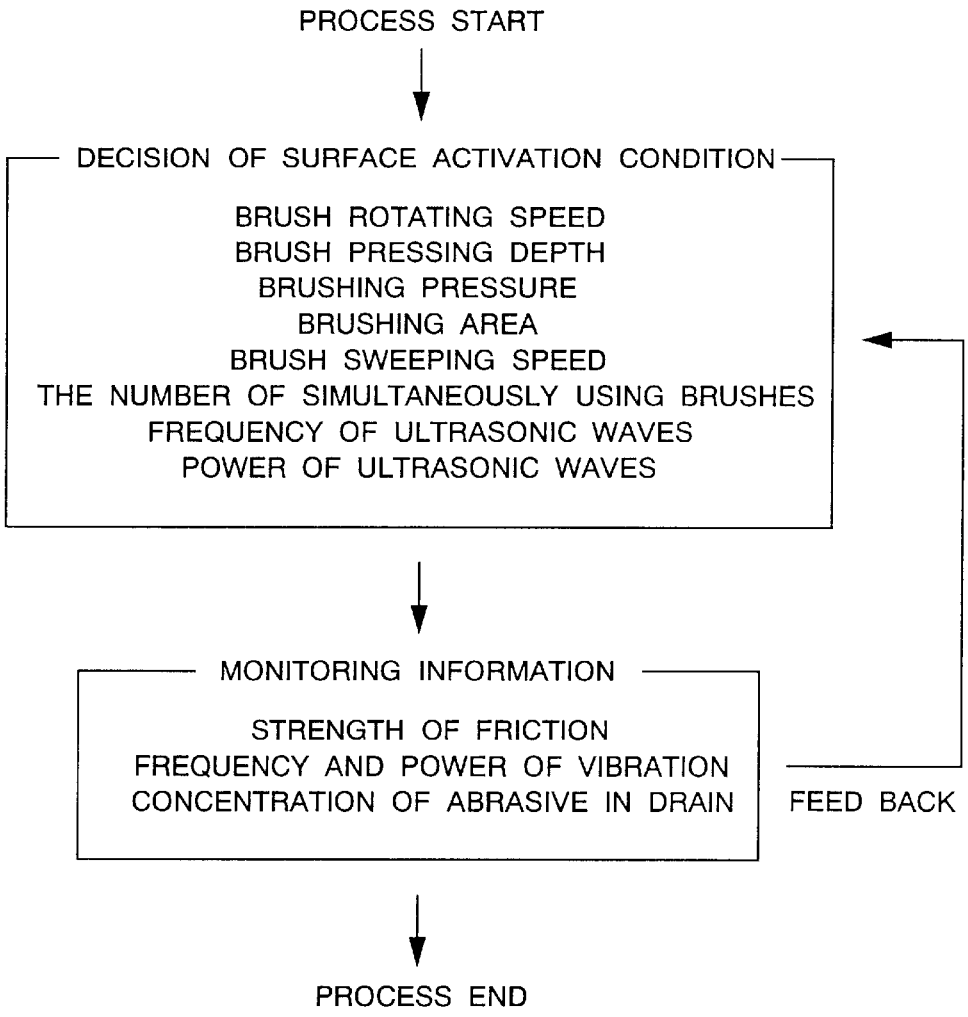
FIG. 15 is a flow chart for controlling the operational condition of surface activation treatment by means of polishing monitor information.

As the fifth example of the present invention, a method in which the operational condition of a surface activation treatment means is determined based on the feedback information obtained from real time monitoring result of polishing as shown in FIG. 15. Monitorial information used for feedback includes the frictional force loaded on a wafer, the vibration of a wafer holder, and the abrasive grain concentration in processing liquid which is being discharged, and controllable operational condition of a surface activation treatment means includes the brush rotation speed, the brush pressing force, the brush pressing height (vertical distance between the brush and grindstone), the brushing area, the brush sweeping speed, the number of brushes used simultaneously, the ultrasonic wave frequency, and ultrasonic wave power. The variation in removal rate is smaller in the case that a surface activation treatment means such as a brush is used for grindstone processing than in the case that no surface activation treatment means is used for grindstone processing. However, the removal rate decrement of about 5% for polishing one wafer is inevitable in spite of using, for example, a brush. The removal rate decrement is detectable as the frictional force decrement between a wafer and a grindstone, and the frictional force can be measured as the additional current of a motor for driving the wafer holder 14 or as the strain of the arm 17 shown in FIG. 1 by use of a semiconductor strain gauge. Therefore, the pressing height of the brush is lowered correspondingly to the detected frictional force decrement to enhance the brushing, and the removal rate is stabilized. For example, the decrement of removal rate of 5% can be compensated by lowering the brush height about 100 $\mu$m to increase the removal rate.

Figure 16:
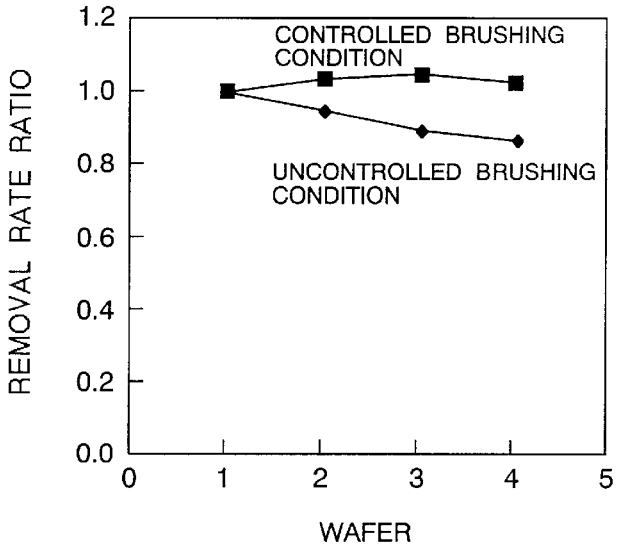
FIG. 16 is a diagram for describing the effect of a method for processing in which the surface activation treatment condition is controlled for every processing.

If a polishing monitor is not used, a method in which the surface activation treatment condition for processing the next wafer is determined based on the variation of the removal rate obtained by measurement of the film thickness of the last wafer may be employed. FIG. 16 shows the comparison of the removal rate variation between the case in which the brush pressing height is lowered every time when one wafer is processed to compensate the decrement of removal rate and the case in which the brushing condition is constant and the removal rate is not compensated. As shown in FIG. 16, the removal rate variation can be limited within ±3% in the case in which the brushing condition is controlled every time when one wafer is processed.

In the surface activation treatment of a grindstone by use of a brush in the example, the flow rate of the processing liquid supplied onto the grindstone simultaneously with the surface activation treatment is limited to 0.14 ml/cm$^2$ or less per minute. The supply rate of the processing liquid of 500 ml/min or less does not affect the removal rate enhancing effect using a brush for a grindstone having a diameter of 700 mm and inside diameter of 200 mm in the experiment. This value is converted into the value per unit area of the grindstone to obtain a value in the range of 0.14 ml/cm$^2$ or less.

EXAMPLE 6

As the sixth example of the present invention, a method in which solid, gel, or aerosol type abrasive grain supply source is used as the grindstone surface activation treatment means is shown.

Figure 17:
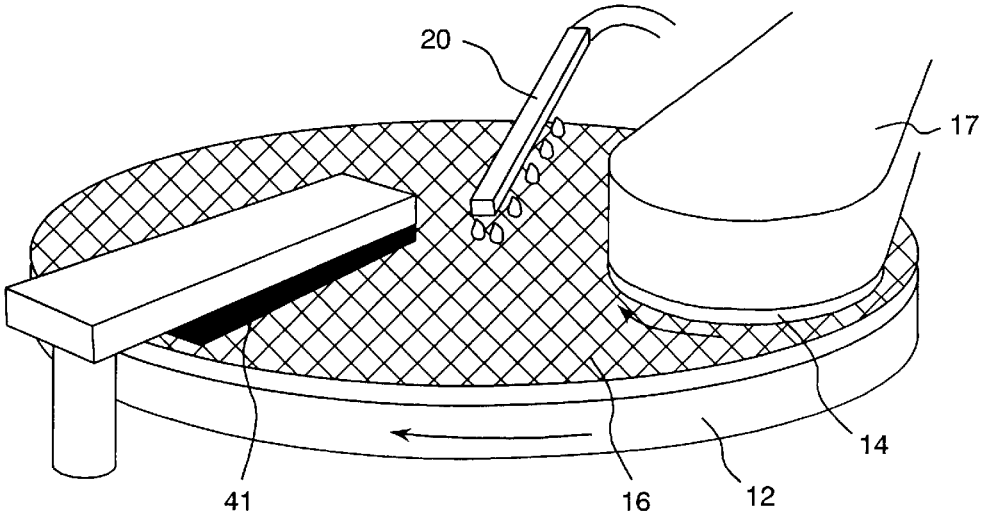
FIG. 17 is a diagram for describing an example in which a solid abrasive grain supply source is used for surface activation treatment of a grindstone.

In FIG. 17, an example in which a grindstone 41 is used as the solid abrasive grain supply source is shown. The grindstone 41 used as the abrasive grain supply source is maintained in contact with a wafer processing grindstone 16 during wafer processing and moved relatively to the wafer processing grindstone 16. Process dust and needless abrasive grains on the surface of the grindstone 16 are discharged, the fresh surface is exposed to increase free abrasive grain concentration, and the removal rate is improved.

For making the grindstone 41 for the abrasive grain supply source, the same abrasive grains as used for making the wafer processing grindstone 16 is used, and the abrasive grains are bonded with a resin having a bonding strength equal to or weaker than the bonding strength of the resin used for bonding the wafer processing grindstone 16. The grain diameter of the abrasive grains used for the abrasive grain supply source grindstone is equal to or smaller than that of the wafer processing grindstone 16, and the pore diameter of the former grindstone 41 is equal to or smaller than that of the latter grindstone 16, thus the polish damaging such as scratch is prevented.

EXAMPLE 7

As the seventh example of the present invention, a method in which an ice grindstone is used as the grindstone surface activation treatment means is shown.

The ice grindstone which is formed by icing a liquid containing abrasive grains is used. The ice grindstone does not contain resin unlike the grindstone which is bonded with resin as shown in Example 6, therefore only the abrasive grains and liquid necessary for processing may be fed, and the free abrasive grain concentration is increased efficiently.

EXAMPLE 8

As the eighth example of the present invention, a method in which gel of a liquid containing abrasive grains is used as the grindstone surface activation treatment means is shown. Herein, gel which is formed by a method in which cerium oxide grains having an average diameter of 0.3 microns, which are used for the wafer processing grindstone, are dispersed in deionized water to form a dispersion and magnesium oxide MgO powder having an average particle diameter of 0.1 micron is added to the dispersion is used as the gel abrasive grain supply source. By using such gel abrasive grain supply source, the surface damage on the wafer processing grindstone is minimized, and the gel abrasive grain supply source is effective for lengthening the service life of the grindstone 16 and preventing scratch on the wafer.

EXAMPLE 9

As the ninth example of the present invention, a method in which aerosol abrasive grain supply source is supplied from a plurality of nozzles is shown.

Figure 18:
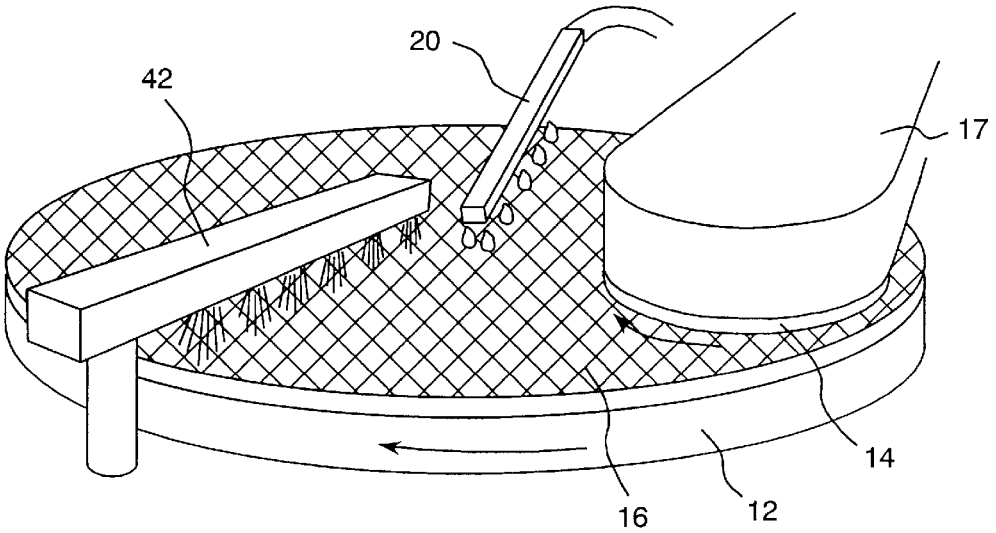
FIG. 18 is a diagram for describing an example in which aerosol abrasive grain supply source is used for surface activation treatment of a grindstone.

The method in which aerosol abrasive grain supply source is used described herein under is effective for supplying free abrasive grains most uniformly on the surface of the wafer processing grindstone 16. As shown in FIG. 18, a plurality of nozzles 42 are provided above the grindstone 16, and abrasive grains and processing liquid are jetted from the nozzles 42 in the form of aerosol. The surroundings of the nozzles are covered with a cover not shown in the drawing to prevent abrasive grains from diffusing into the atmosphere. Abrasive grains are jetted uniformly on the grindstone 16 surface and the free abrasive grain distribution is uniform, this method is effective for uniformalizing the process distribution on a wafer 1 also for enhancing the removal rate.

EXAMPLE 10

As the tenth example of the present invention, a method in which a polishing pad for planarizing concave/convex pattern of a semiconductor wafer and solid, gel, or aerosol abrasive grain supply source are combinedly used is shown. Herein, a slurry, which is a liquid containing abrasive grains and has been used usually heretofore, is not used. Abrasive grains are supplied onto a polishing pad by use of any one of or a combination of a grindstone formed by bonding abrasive grains with resin, an ice grindstone formed by icing a processing liquid containing abrasive grains, gel containing abrasive grains and a processing liquid, and aerosol containing abrasive grains and a processing liquid instead of a slurry.

Figure 19:
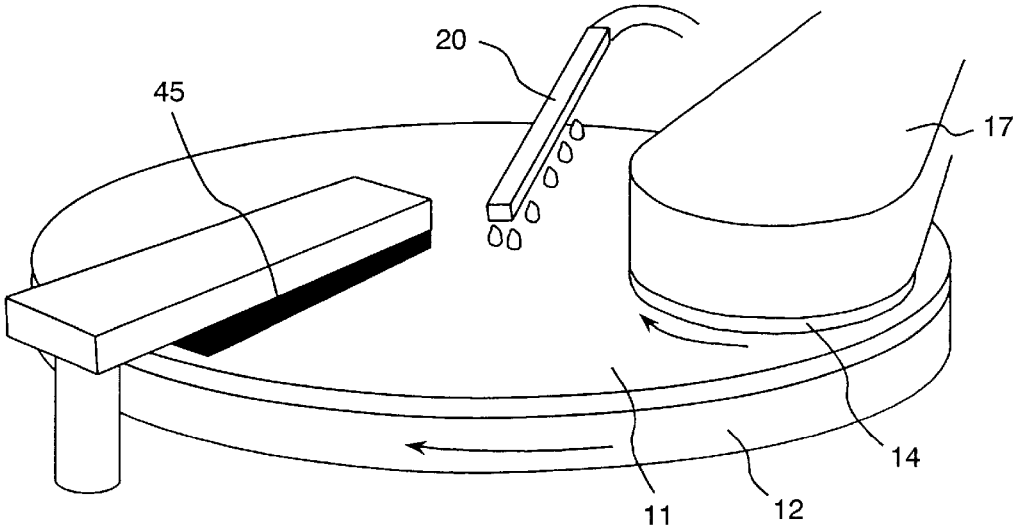
FIG. 19 is a diagram for describing an example in which a solid abrasive grain supply source is used for a polishing pad.

First, the case in which a grindstone or an ice grindstone, and gel containing abrasive grains and a processing liquid are used combinedly as the abrasive grain supply source for supplying abrasive grains onto a polishing pad is shown in FIG. 19. An abrasive grain supply source 45 is pressed on the polishing pad 11 with contact to supply abrasive grains from the abrasive grain supply source 45 to the polishing pad 11.

In the case that the grindstone comprising abrasive grains and resin is used as the abrasive grain supply source 45, both dressing of the worn polishing pad surface and supply of abrasive grains are carried out simultaneously due to the effect obtained by pressing a grindstone which is harder than the polishing pad. This method is suitable for automation because a grindstone is used as the abrasive supply source instead of slurry which is not suitable for automation.

EXAMPLE 11

As the 11th example of the present invention, an example in which a soft film is polished is shown.

In the case in which a film to be processed on the wafer is a soft film such as BPSG film or aluminum film, an ice grindstone which is formed by icing abrasive grains and a processing liquid is used as the abrasive grain supply source. An ice grindstone does not contain resin for bonding abrasive grains and does not generates agglomerated grindstone fragments containing abrasive grains and resin. The surface of a soft polishing pad, which is suitable for processing a soft film, is not roughened excessively, and is damaged little. The ice grindstone allows us to process a soft film without causing polishing damage such as scratch.

EXAMPLE 12

As the 12th example of the present invention, another example in which a soft film is polished is shown.

To reduce more the damage on a soft film, gel containing abrasive grains and a liquid is used as the abrasive grain supply source. Herein, gel containing magnesium oxide MgO powder having an average particle diameter of 0.3 micron which is abrasive grains used for wafer processing, is used as the gel abrasive grain supply source. By using such soft gel abrasive grain supply source, the surface damage on a polishing pad 11 is minimized and the service life of a polishing pad 11 is lengthened, and scratching is prevented.

EXAMPLE 13

As the 13th example of the present invention, an example in which aerosol abrasive grain source is used and aerosol abrasive grains are supplied from a plurality of nozzles is shown.

Figure 20:
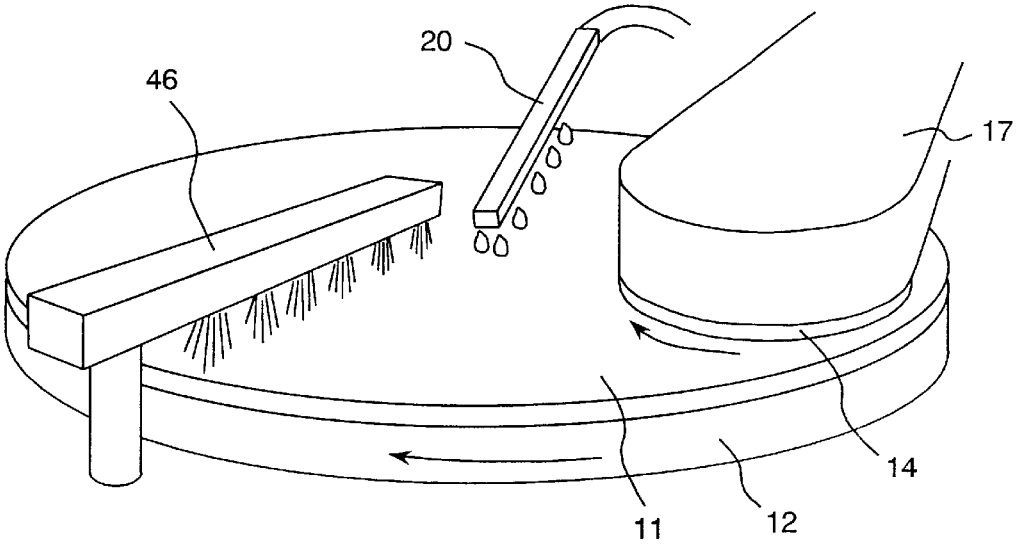
FIG. 20 is a diagram for describing an example in which a aerosol abrasive grain supply source is used for a polishing pad.
Figure 21:
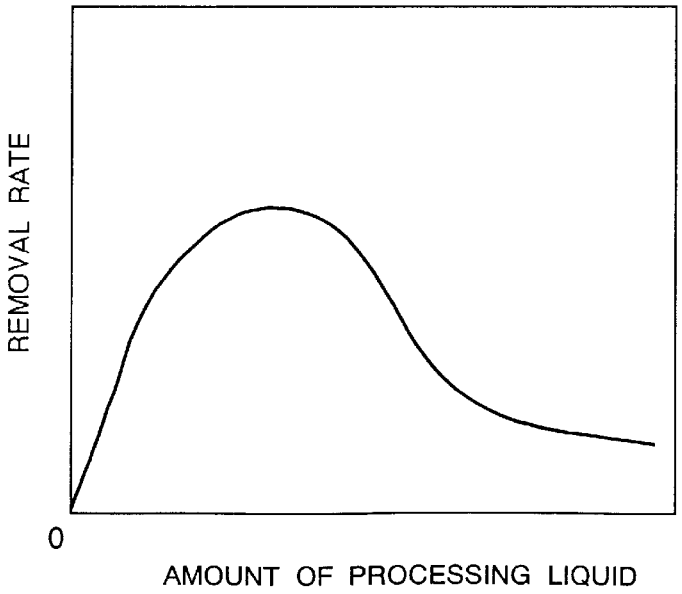
FIG. 21 is a diagram for describing the relation between the amount of processing liquid supplied to a grain stone and the removal rate.
Figure 22A:
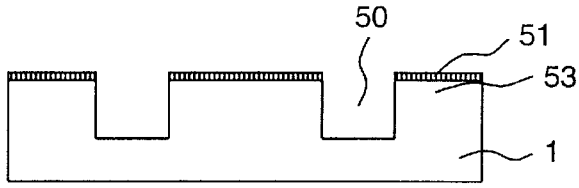
FIG. 22(*a*) to FIG. 22(*d*) are diagrams for describing an example in which the present invention is applied to the isolation process.
Figure 22B:
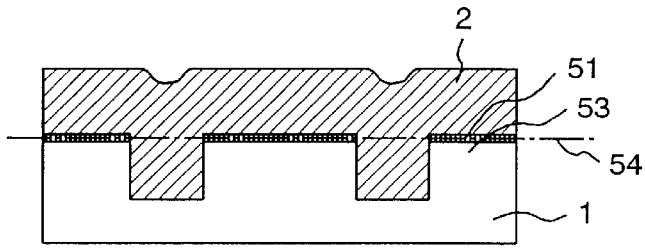
Figure 22C:
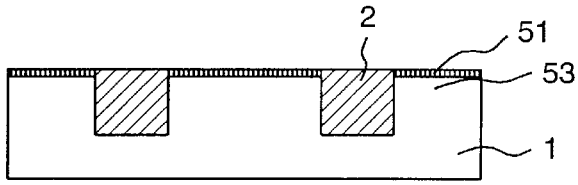
Figure 22D:
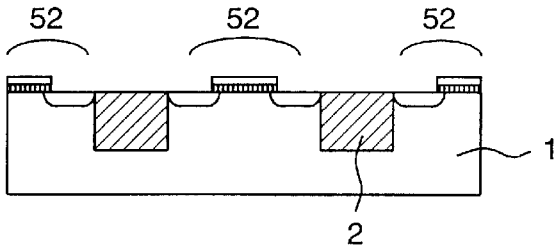

A method in which aerosol grain supply source is used described herein under is most effective for supplying free abrasive grains most uniformly on the surface of a polishing pad 11. As shown in FIG. 20, a plurality of nozzles 46 are provided above a polishing pad 11, abrasive grains and a processing liquid are jetted in the form of aerosol from the nozzles 46. The surroundings of the nozzles is covered with a cover to prevent abrasive grains from diffusing into the atmosphere. Abrasive grains are jetted uniformly on the surface of the polishing pad 11 and the free abrasive grain concentration distribution is uniform, and the aerosol abrasive grain source is effective for uniformalizing the process distribution on a wafer 1.

EXAMPLE 14

As the 14th example of the present invention, a method for fabricating a semiconductor device to which the processing method is applied is shown. FIG. 22(*a*) to FIG. 22(*d*) are diagrams for describing isolation process before transistors or the like are formed on a wafer substrate. These are enlarged cross sectional side views of the surface of a wafer. FIG. 22(*a*) shows the step in which a shallow trench 50 for isolation is formed by dry etching on the wafer substrate 1. The element forming region 53 where transistors or the like are to be formed afterward is protected by a nitride film 51 deposited by CVD process. FIG. 22(*b*) shows the step in which a dielectric film 2 of silicon dioxide is deposited by thermal oxidation process or CVD process on the entire surface of the wafer and the dielectric film 2 is embedded in the shallow trench 50. Next, the dielectric film 2 is polished and planarized to the level 54 shown in FIG. 22 (*b*) by means of the processing method of the present invention to remove unnecessary portion of the dielectric film 2 excepting the dielectric film 2 embedded in the shallow trench 50, and the intermediate product shown in FIG. 22(*c*) is obtained. Subsequently the nitride film 51 is removed by use of etchant such as hot phosphoric acid. FIG. 22(*d*) shows the step in which elements such as transistors 52 are formed on the element forming region 53 through many processes such as thermal oxide film removal, gate oxide film deposition, and ion implantation. The surface of the dielectric film 2 in the shallow trench should be highly planer and non-defective so that the performance of elements formed later is not damaged. The throughput is also required, therefore the application of the present invention to the planarization process is effective.

In addition to the application, the present invention is effectively applied to the planarization process of dielectric films between wiring layers.

In addition to the application to dielectric film, the present invention is effectively applied to polish conductive films such as copper wiring for Damascene processing or aluminum film.

According to the method for fabricating a semiconductor device as described herein above, by introducing a grindstone surface activation treatment means in planarization processing method using a grindstone out of the wafer surface pattern planarization technique involving polishing processing method used in the process for fabricating a semiconductor integrated circuit, it is possible to improve the polishing processing efficiency and to bring about low cost planarization processing. By introducing the grindstone surface activation treatment means in processing, the removal rate is stabilized, therefore it is possible to adjust the total polishing depth to a desired value. As the result, the insufficient polishing or excessive polishing is reduced, and the fraction defective decreases. Because re-polishing step to modify the insufficient polishing is not necessary, and the total number of steps can be reduced. Further, because the thickness of a dielectric film on a semiconductor wafer which is the processing object is controlled precisely, it is possible to optimize the electric performance of the film to improve the production yield of semiconductor device.

According to the processing apparatus of the present invention, because the wafer polishing efficiency is improved and the polishing depth is controlled easily, the throughput of the device is improved.

As described in the respective examples, according to the method for fabricating a semiconductor of the present invention, by introducing a grindstone surface activation treatment means in planarization processing method using a grindstone out of the wafer surface pattern planarization technique involving polishing processing method used in the process for fabricating a semiconductor integrated circuit, it is possible to improve the polishing processing efficiency and to bring about low cost planarization processing. By introducing the grindstone surface activation treatment means in processing, the removal rate is stabilized, therefore it is possible to adjust the total polishing amount to a desired value. As the result, the insufficient polishing or excessive polishing is reduced, and the production yield is improved. Because re-polishing step to modify the insufficient polishing is not necessary, and the total number of steps can be reduced. Further, because the thickness of a dielectric film on a semiconductor wafer which is the processing object is controlled precisely, it is possible to optimize the electric performance of the film to improve the production yield of semiconductor device.

According to the processing apparatus of the present invention, because the wafer polishing efficiency is improved and the polishing depth is controlled easily, the throughput of the device is improved.

What is claimed is:

1. A method for fabricating a semiconductor device, comprising the steps of:

polishing a semiconductor wafer having a concave/convex patterned surface, under which a device is formed, with a grindstone constituted of abrasive grains and material for bonding together the abrasive grains onto the grindstone, said semiconductor wafer is pressed with relative motion to planarize said concave/convex pattern, and applying a surface activation treatment to liberate said abrasive grains from said grindstone for making said abrasive grains work to polish said concave/convex patterned surface.

2. A method for fabricating a semiconductor device according to claim 1, wherein said step of applying a surface activation treatment is carried out by using a brush which is pressed onto said grindstone.

3. A method for fabricating a semiconductor device comprising a process for polishing a semiconductor wafer having a concave/convex patterned surface by using a grindstone constituted of abrasive grains and material for holding the abrasive grains onto which said semiconductor wafer is pressed with relative motion to planarize said concave/convex pattern, wherein said grindstone surface activation treatment includes transmission of ultrasonic wave or acoustic wave having a frequency of 10 kHz or higher to said grindstone.

4. A method for fabricating a semiconductor device, comprising the steps of:

polishing a semiconductor wafer having a concave/convex patterned surface, under which a device is formed, with a grindstone constituted of abrasive grains and material for bonding together the abrasive grains onto the grindstone, said semiconductor wafer is pressed with relative motion to planarize said concave/convex pattern, applying a surface activation treatment to said grindstone for making said abrasive grains work to polish said concave/convex patterned surface, detecting a state of said polishing, and controlling the condition of said grindstone surface activation treatment based on a value of the detected state of polishing.

5. A method for fabricating a semiconductor device according to claim 4, wherein said polishing state to be detected is the thickness of a semiconductor wafer, and said controlling step is carried out after completion of the step of polishing said semiconductor wafer.

6. A method for fabricating a semiconductor device comprising the steps of:

applying surface activation treatment to a grindstone constituted of abrasive grains and material for bonding together said abrasive grains for making said abrasive grains work to polish a surface of said semiconductor device, supplying a liquid to said grindstone at a flow rare of not more than 0.14 ml/cm 2 per minute per unit area of said grindstone, and polishing a semiconductor wafer having a concave/convex patterned surface under which a device is formed by using said grindstone pressed onto the surface of said semiconductor wafer to planarize said semiconductor wafer surface.

7. A method for fabricating a semiconductor device according to claim 6, wherein said grindstone surface activation treatment is carried out by using a brush which is pressed onto said grindstone.

8. A method for fabricating a semiconductor device according to claim 7, wherein said grindstone is brushed with said brush pressed onto said grindstone so that the contact length of bristles of said brush with said grindstone is in a range from 0.1 mm to 5 mm.

9. A method for fabricating a semiconductor device according to claim 6, wherein said grindstone surface activation treatment includes transmission of ultrasonic wave or acoustic wave having a frequency of 10 kHz or higher to said grindstone.

10. A method for fabricating a semiconductor device according to claim 6, wherein said surface activation treatment includes supplying of abrasive grains on said grindstone surface from a solid abrasive grain supply source.

11. A method for fabricating a semiconductor device according to claim 10, wherein said solid abrasive grain supply source is the second grindstone constituted of abrasive stone and material for holding said abrasive grains.

12. A method for fabricating a semiconductor device according to claim 10, wherein said solid abrasive grain supply source is iced liquid containing abrasive grains.

13. A method for fabricating a semiconductor device according to claim 6, wherein said surface activation treatment includes supplying of abrasive grains onto said grindstone surface from gel of liquid or aerosol of liquid containing abrasive grains.

14. A method for fabricating a semiconductor device according to claim 6, wherein said surface activation treatment and said planarization are carried out simultaneously.

15. A method for fabricating a semiconductor device comprising the steps of:

applying surface activation treatment on a grindstone constituted of abrasive grains and material for bonding together said abrasive grains for making said abrasive grains work to polish a surface of said semiconductor device, applying truing treatment to said grindstone, and polishing a semiconductor wafer having a concave/convex patterned surface under which a device is formed by using said grindstone pressed onto the surface of said semiconductor wafer to planarize said semiconductor wafer surface, wherein said truing treatment is conducted to said grindstone for making the grindstone surface to be predetermined measure.

16. A method for fabricating a semiconductor device according to claim 15, wherein the planarity of said grindstone is maintained 10 $\mu$m or smaller.

17. A method for fabricating a semiconductor device comprising the steps of;

polishing a semiconductor wafer by using a polishing pad onto which surface said semiconductor wafer is pressed with relative motion, supplying abrasive grains to the surface of said polishing pad from a solid abrasive grain supply source containing said abrasive grains, and planalizing a surface of a semiconductor wafer.

18. A method for fabricating a semiconductor device according to claim 17, wherein said solid abrasive grain supply source is a grindstone constituted of abrasive grains and material for holding said abrasive grains.

19. A method for fabricating a semiconductor device according to claim 17, wherein said solid abrasive grain supply source is iced liquid containing abrasive grains.

20. A method for fabricating a semiconductor device comprising the steps of;

polishing a semiconductor wafer having concave/convex pattern on a surface thereof by using a polishing pad onto which surface said semiconductor wafer is pressed with relative motion, supplying abrasive grains to the surface of said polishing pad from aerosol of a liquid containing said abrasive grains, and planarizing said concave/convex pattern.

21. A method for fabricating a semiconductor device comprising the steps of;

polishing a semiconductor wafer having concave/convex pattern on the surface thereof by using a polishing pad onto which surface said semiconductor wafer is pressed with relative motion, supplying abrasive grains to the surface of said polishing pad from aerosol of a liquid containing said abrasive grains, and planarizing said concave/convex pattern.

22. A method for fabricating a semiconductor device comprising the steps of:

forming a film having a concave/convex patterned surface under which a device is formed on a semiconductor substrate, and applying surface activation treatment to a grindstone for liberating abrasive grains from the grindstone which is constituted of abrasive grains and material for bonding together said abrasive grains for making said abrasive grains work to polish said film on the semiconductor substrate, and polishing said film by using said grindstone onto which surface said semiconductor substrate is pressed thereby to planarize said film.

23. A method for fabricating a semiconductor device according to claim 22, wherein said film is a dielectric film.

24. A method for fabricating a semiconductor device according to claim 22, wherein said film is a conductive film.

25. A method for fabricating a semiconducror device comprising the steps of:

forming a trench to be served as an isolation region on a semiconductor substrate, forming a dielectric film in said trench and on the semiconductor substrate out of said trench, polishing said dielectric film having a concave/convex patterned dielectric film surface by using a grindstone onto which surface said semiconductor substrate is pressed while applying surface activation treatment to said grindstone for liberating said abrasive grains from said grindstone which is constituted of abrasive grains and material for bonding together said abrasive grains to make said abrasive grains work to polish said dielectric film, and forming a field-effect transistor on a region other than said isolation region.

26. A method for fabricating a semiconductor device according to claim 25, wherein said surface activation treatment is carried out by using a brush pressed onto said grindstone.

27. A method for fabricating a semiconductor device according to claim 25, wherein said surface activation treatment is carried out by transmitting ultrasonic wave or acoustic wave having a frequency of 10 kHz or higher.

28. A processing apparatus comprising;

a holding means for holding a polishing object, a grindstone constituted of abrasive grains and material for holding said abrasive grains, a means for pressing said polishing object on said grindstone with relative motion, a means for surface activation treatment for liberating said abrasive grains, and a means for controlled depth machining of said grindstone.

29. A processing apparatus comprising;

a holding means for holding a polishing object, a grindstone including abrasive grains and bonding resin, a means for pressing said polishing object onto said grindstone with relative motion, and a solid abrasive grain supply source for supplying abrasive grains on the surface of said grindstone.

30. A processing apparatus comprising;

a holding means for holding a polishing object, a grindstone including abrasive grains and bonding resin, a means for pressing said polishing object onto said grindstone with relative motion, and an abrasive grain supply source including gel of liquid or aerosol of liquid for supplying abrasive grains on the surface of said grindstone.

31. A processing apparatus comprising;

a holding means for holding a polishing object, a polishing pad, a means for pressing said polishing object onto said polishing pad with relative motion, and a solid abrasive grain supply source for supplying abrasive grains onto the surface of said polishing pad.

32. A processing apparatus comprising;

a holding means for holding a polishing object, a polishing pad, a means for pressing said polishing object onto said polishing pad with relative motion, and an abrasive grain supply source including gel of liquid or aerosol of liquid for supplying abrasive grains onto the surface of said polishing pad.

33. A method for fabricating a semiconductor device according to claim 1, wherein said step of polishing the semiconductor wafer with a grindstone is carried out using a grindstone which comprises pores, and the pores having a pore diameter of 1 pin or smaller occupying at least 95% of the total pores by volume.

* * * * *